US007252070B2

(12) United States Patent
Magel

(10) Patent No.: US 7,252,070 B2
(45) Date of Patent: Aug. 7, 2007

(54) FUEL INJECTION DEVICE FOR AN INTERNAL COMBUSTION ENGINE

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 86 days.

(21) Appl. No.: 10/542,317

(22) PCT Filed: Oct. 7, 2003

(86) PCT No.: PCT/DE03/03323

§ 371 (c)(1),
(2), (4) Date: Nov. 9, 2005

(87) PCT Pub. No.: WO2004/070201

PCT Pub. Date: Aug. 19, 2004

(65) Prior Publication Data

US 2006/0231076 A1 Oct. 19, 2006

(30) Foreign Application Priority Data

Jan. 15, 2003 (DE) ..... 103 01 194

(51) Int. Cl.
*F02M 37/04* (2006.01)

(52) U.S. Cl. ..... 123/446; 123/447; 123/511

(58) Field of Classification Search ..... 123/446, 123/447, 510, 511
See application file for complete search history.

(56) References Cited

U.S. PATENT DOCUMENTS 4,712,528 A * 12/1987 Schaffitz ..... 123/446
5,433,182 A * 7/1995 Augustin et al. ..... 123/456
5,954,032 A 9/1999 Augustin et al.
6,374,802 B1 * 4/2002 Boecking ..... 123/446
6,520,152 B1 * 2/2003 Mahr et al. ..... 123/447
6,637,408 B2 * 10/2003 Djordjevic ..... 123/456
2002/0002964 A1 * 1/2002 Kohketsu et al. ..... 123/447
2006/0162695 A1 * 7/2006 Shibata ..... 123/446

FOREIGN PATENT DOCUMENTS

DE 196 51 671 A1 6/1998
DE 197 47 092 A1 4/1999
EP 1 273 797 A2 1/2003

* cited by examiner

*Primary Examiner*—Thomas Moulis
(74) *Attorney, Agent, or Firm*—Ronald E. Greigg

(57) ABSTRACT

A fuel injection system for an internal combustion engine and having a high-pressure fuel pump and a fuel injection valve for each engine cylinder. A first electrically actuated control valve controls a connection of the pump working chamber to a low-pressure region and a second electrically actuated control valve controls a connection of a control pressure chamber of the fuel injection valve to a relief region. A pressure reservoir is filled by the high-pressure fuel pump and from which fuel can be withdrawn in order to execute a fuel injection with the fuel injection valve independent of the delivery from the high-pressure fuel pump. The connection between the fuel pump and the pressure reservoir and injection valve contains a coupling device having a piston acted on at one end by the pressure prevailing in the pressure reservoir acted on at the other end by the pressure prevailing in the connection. The piston executes a delivery stroke oriented toward the pressure chamber in order to execute a fuel injection, and that the coupling device contains a bypass connection via which the connection communicates with the pressure reservoir.

19 Claims, 3 Drawing Sheets

FUEL INJECTION DEVICE FOR AN INTERNAL COMBUSTION ENGINE

CROSS-REFERENCE TO RELATED APPLICATIONS

This application is a 35 USC 371 application of PCT/DE 03/03323 filed on Oct. 7, 2003.

BACKGROUND OF THE INVENTION

1. Field of the Invention

The invention is directed to an improved fuel injection system for an internal combustion engine.

2. Description of the Prior Art

A fuel injection system of the type with which this invention is concerned is known from DE 101 32 732 A and has a respective high-pressure fuel pump and a fuel injection valve connected to it for each cylinder of the internal combustion engine. The high-pressure fuel pump has a pump piston that is driven into a stroke motion and delimits a pump working chamber. The pump working chamber can be connected to a low-pressure region via a connection controlled by a first electrically actuated control valve. The fuel injection valve has an injection valve element that controls at least one injection opening and that is acted on in an opening direction by the pressure prevailing in a pressure chamber connected to the pump working chamber. An electrical control element controls an opening and closing motion of the injection valve element. The fuel injection valve here has a control pressure chamber that can be connected to the pump working chamber and can also be connected to a relief region via a connection controlled by the control element, which is embodied as a second electrically actuated control valve. A pressure reservoir is also provided into which fuel is delivered by the high-pressure fuel pump and which is connected to the pressure chamber of the fuel injection valve. Fuel can be drawn from the pressure reservoir for an injection, independent of the delivery by the high-pressure fuel pump. In particular, this permits a secondary injection of high-pressure fuel, which can occur at a time when the high-pressure fuel pump has already stopped delivering fuel. A secondary injection of this kind is advantageous for reducing emissions of the engine, especially particulate emissions. The connection of the pump working chamber and pressure chamber to the pressure reservoir contains a throttle restriction and, parallel to this, a check valve that opens toward the pressure chamber. A filling of the pressure reservoir with fuel occurs only via the throttle restriction, which must be large enough to permit a sufficient filling of the pressure reservoir even when the pressure generated by the high-pressure fuel pump is not very high and when the fuel injection quantity is low. In addition, after the termination of fuel injection, a high pressure must be maintained in the pressure chamber in order to be able to deliver a large fuel quantity into the pressure reservoir, which requires a large amount of driving work from the high-pressure fuel pump, thus resulting in a poor efficiency of the fuel injection system. Because of the significant pressure differences between the pressure reservoir on the one hand and the pump working chamber and pressure-relieved pressure chamber on the other, an expensively designed check valve is required in order to assure a reliable seal between them.

SUMMARY AND ADVANTAGES OF THE INVENTION

The fuel injection system according to the invention has the advantage over the prior art that the coupling device with the piston permits a simply designed connection of the pressure reservoir to the pressure chamber and pump working chamber and does not require a sealing seat. For a fuel injection independent of the delivery by the high-pressure fuel pump, the piston executes a delivery stroke oriented toward the pressure chamber.

Advantageous embodiments and modifications of the fuel injection system according to the invention are disclosed. On embodiment provides a simple bypass connection and in another the bypass connection can be embodied with a small flow cross section since the pressure reservoir is also filled by means of the stroke of the piston of the coupling device. One modification assures that the piston assumes a definite starting position from which the piston executes a stroke for fuel delivery into the pressure reservoir or a delivery stroke toward the pressure chamber. Another embodiment assures that the piston assumes a definite starting position from which the piston executes a delivery stroke toward the pressure chamber; the pressure reservoir is filled only via the bypass connection.

BRIEF DESCRIPTION OF THE DRAWINGS

Other features and advantages of the invention will be apparent from the description contained herein below, taken in conjunction with the drawings, in which.

DESCRIPTION OF THE PREFERRED EMBODIMENTS

Figure 1:
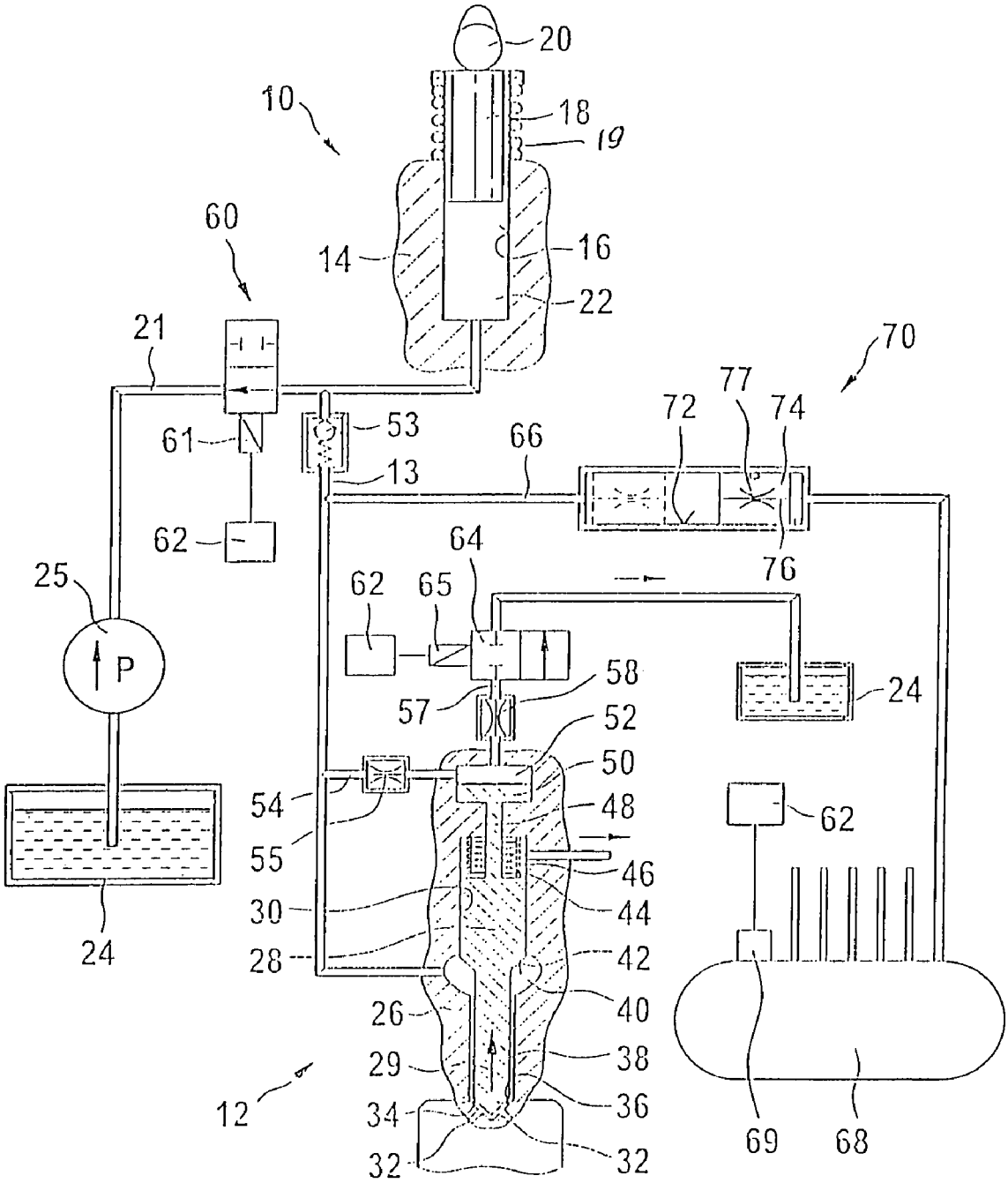
FIG. 1 is a schematic depiction of a fuel injection system for an internal combustion engine according to a first exemplary embodiment.
Figure 2:
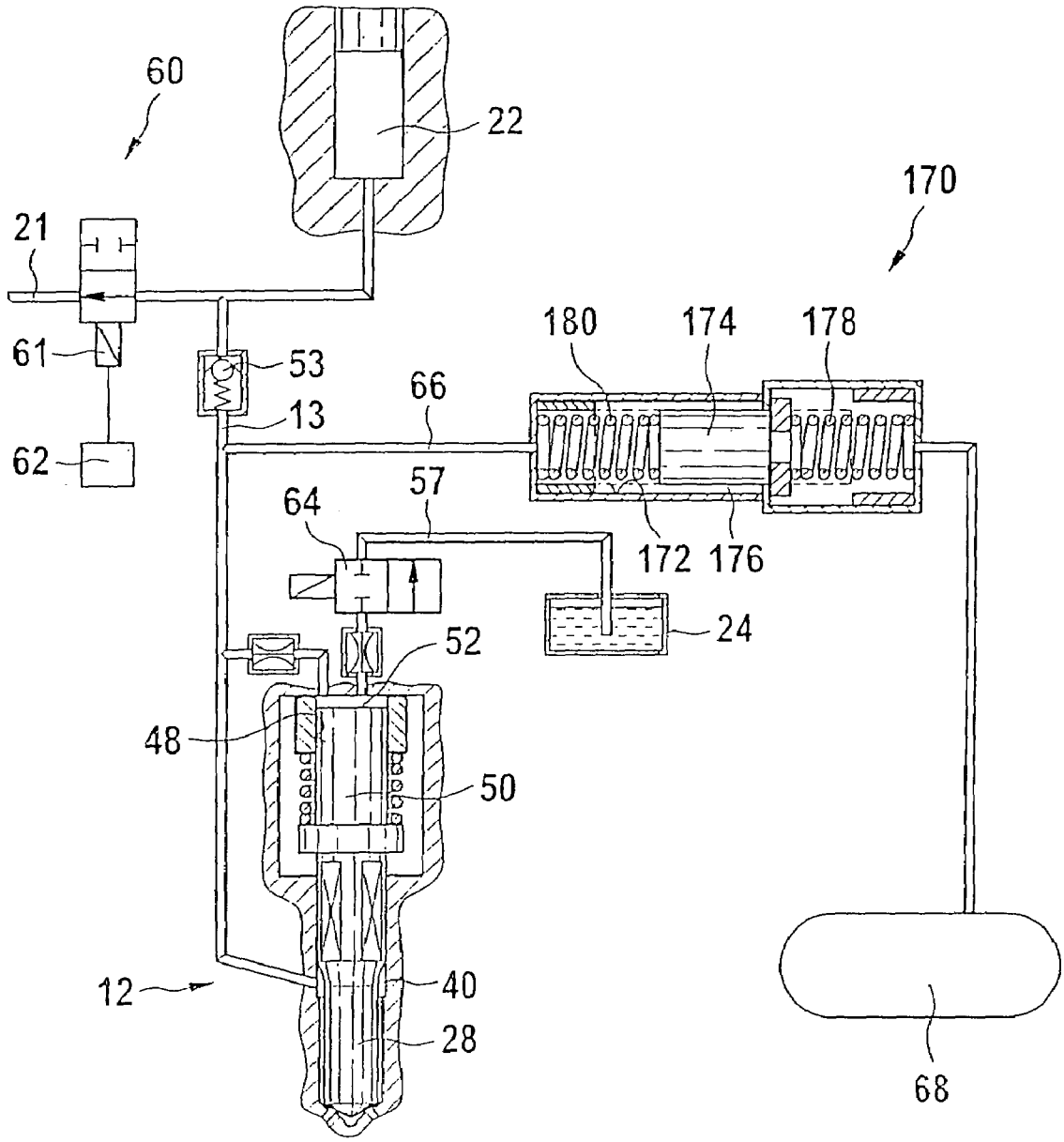
FIG. 2 shows a detail of the fuel injection system according to a second exemplary embodiment.
Figure 3:
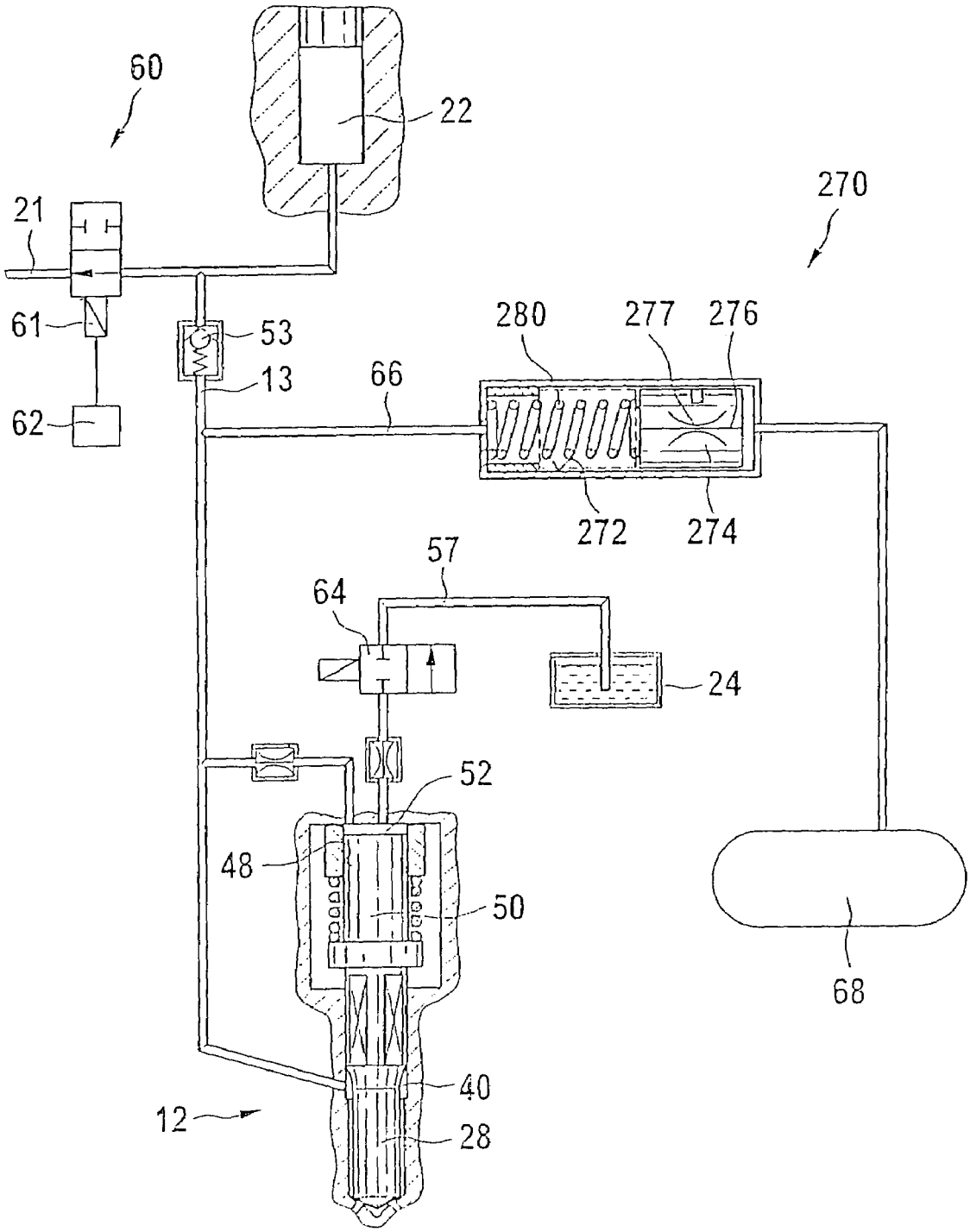
FIG. 3 shows a detail of the fuel injection system according to a third exemplary embodiment.

FIGS. 1 to 3 show a fuel injection system for an internal combustion engine of a motor vehicle. The fuel injection system has a respective high-pressure fuel pump 10 and a fuel injection valve 12 connected to it for each cylinder of the engine. The high-pressure fuel pump 10 and the fuel injection valve 12 can be combined into a single component, thus comprising a so-called unit injector. Alternatively, the high-pressure fuel pump 10 and the fuel injection valve 12 can also be disposed separate from each other and connected via a line, thus comprising a so-called unit pump.

The high-pressure fuel pump 10 has a pump piston 18 that is guided in a sealed fashion in a cylinder bore 16 of a pump body 14 and is driven into a stroke motion by a cam 20 of a camshaft of the engine, counter to the force of a return spring 19. In the cylinder bore 16, the pump piston 18 delimits a pump working chamber 22, in which the pump piston 18 compresses fuel at high pressure. The pump working chamber 22 is supplied with fuel from a fuel tank 24 via a connection 21, for example by means of a fuel supply pump 25. The connection 21 of the pump working chamber 22 to the fuel supply pump 25 contains a first electrically actuated control valve 60. The control valve 60 is embodied as a 2/2-way valve and is triggered by an electronic control unit 62. The control valve 60 has an actuator 61 that can be an electromagnet or a piezoelectric actuator.

The fuel injection valve 12 has a valve body 26 that can be comprised of a number of parts and contains a piston-shaped injection valve element 28 that is guided so that it can slide longitudinally in a bore 30. In its end region oriented toward the combustion chamber of the engine cylinder, the valve body 26 has at least one, preferably several injection openings 32. In its end region oriented toward the combustion chamber, the injection valve element 28 has a for example approximately conical sealing surface 34 that cooperates with a valve seat 36 embodied in the valve body 26; the injection openings 32 branch off either from this valve seat or from downstream of it. In the valve body 26, between the injection valve element 28 and the bore 30 toward the valve seat 36, there is an annular space 38 that transitions via a radial expansion of the bore 30 into a pressure chamber 40 that encompasses the injection valve element 28. The injection valve element 28 has a pressure shoulder 42 in the region of the pressure chamber 40. The end of the injection valve element 28 oriented away from the combustion chamber is engaged by a prestressed closing spring 44, which presses the injection valve element 28 toward the valve seat 36. The closing spring 44 is contained in a spring chamber 46 of the valve body 26, which adjoins the bore 30. The spring chamber 46 is connected to a relief region that can, for example, be a return to the fuel tank 24. At its end oriented away from the bore 30, the spring chamber 46 can be adjoined in the valve body 26 by another bore 48 in which a control piston 50 that is connected to the injection valve element 28 is guided in a sealed fashion. With its end surface oriented away from the spring chamber 46, the control piston 50 delimits a control pressure chamber 52 in the valve body 26.

A connection 13 leading from the pump working chamber 22 feeds into the pressure chamber 40 in the valve body 26. The connection 13 that leads between the pump working chamber 22 and the first control valve 60 contains a check valve 53 that opens toward the pressure chamber 40. The check valve 53 permits a fuel delivery from the high-pressure fuel pump 10 into the pressure chamber 40, but prevents a return flow of fuel from the pressure chamber 40 into the pump working chamber 22 or to the fuel supply pump 25 when the first control valve 60 is open. Upstream of the pressure chamber 40, a connection 54 that contains a throttle restriction 55 leads from the connection 13 into the control pressure chamber 52. In addition, a connection 57 that contains a throttle restriction 58 leads from the control pressure chamber 52 to a relief region, for example a return to the fuel tank 24. The connection 57 contains a second electrically actuated control valve 64, which is embodied as a 2/2-way valve and is controlled by the control unit 62. The second control valve 64 has an actuator 65, which can be an electromagnet or a piezoelectric actuator. The pressure prevailing in the control pressure chamber 52 acts on the injection valve element 28 in the closing direction in addition to the closing spring 44. The second control valve 64 controls the pressure prevailing in the control pressure chamber 52 by opening or closing the connection 57 to the relief region. The second control valve 64 thus constitutes an electrical control element that controls the opening and closing motion of the injection valve element 28. When the second control valve 64 is closed, the injection valve element 28 remains in its closed position or is moved into its closed position due to the high pressure in the control pressure chamber 52. When the second control valve 64 is open, the injection valve element 28 can move into its open position as a result of the low pressure in the control pressure chamber 52 if there is a high enough pressure in the pressure chamber 40. In lieu of controlling the opening and closing motion of the injection valve element 28 by means of the second control valve 64, this function can also be performed, for example, by a piezoelectric actuator, which directly or indirectly acts on the injection valve element 28 in its closing direction. The control pressure chamber 52 and the second control valve 64 can then be eliminated.

Downstream of the check valve 53, a connection 66 to a pressure reservoir 68 branches off from the connection 13 between the pump working chamber 22 and the pressure chamber 40 and control pressure chamber 52. The connection 66 contains a coupling device 70, which FIG. 1 depicts in accordance with a first exemplary embodiment. The coupling device 70 has a piston 74 that is guided so that it can slide in a cylinder bore 72. The coupling device 70 has a bypass connection between the two end surfaces of the piston 74, which can be embodied, for example, as a conduit 76 extending through the piston 74. The conduit 76 contains a throttle restriction 77. The bypass connection can alternatively also be embodied, as in a second exemplary embodiment described below, in the form of an annular gap 176 with a small cross section that extends between the cylinder bore 172 and the outer circumference of the piston 174. On its end surface oriented toward the pressure reservoir 68, the piston 74 is acted on by the pressure prevailing in the pressure reservoir 68 and on its end surface oriented away from the pressure reservoir 68, is acted on by the pressure prevailing in the connection 13. The piston 74 can be moved back and forth in the cylinder bore 72 between an end position oriented toward the pressure reservoir 68 and an end position oriented toward the connection 13, i.e. away from the pressure reservoir 68. Preferably a common pressure reservoir 68 is provided for all of the cylinders of the internal combustion engine. The pressure reservoir 68 can be embodied as a separate component, for example in a tubular or spherical form. Alternatively, the pressure reservoir can also be constituted by an internal volume of the fuel injection system or by the volume in the connecting lines of the fuel injection system. The pressure reservoir 68 can be provided with a pressure relief device 69, which limits the pressure prevailing in the pressure reservoir 68 to a predetermined value. The pressure relief device 69 can be embodied as a pressure relief valve that limits the pressure in the pressure reservoir 68 to a constant value. Alternatively, the pressure relief device 69 can also be embodied as a control valve that can limit the pressure prevailing in the pressure reservoir 68 in a variable fashion, for example as a function of operating parameters of the engine, and can be triggered by the control unit 62.

The function of the fuel injection system will be explained below. During an intake stroke of the pump piston 18, the first control valve 60 is opened so that the fuel supply pump 25 delivers fuel from the fuel tank 24 into the pump working chamber 22 via the connection 21. The check valve 53 is closed in this instance since the pressure generated by the fuel supply pump 25 is less than the pressure prevailing in the pressure chamber 40, the control pressure chamber 52, and the connection 13 downstream of the check valve 53. During the delivery stroke of the pump piston 18, the first control valve 60 is closed so that high pressure builds up in the pump working chamber 22. If the pressure in the pump working chamber 22 is greater than the pressure prevailing in the pressure chamber 40 and the control pressure chamber 52, then the check valve 53 opens and fuel travels to the fuel injection valve 12. If the second control valve is closed 64, then at least approximately the same pressure prevails in the control pressure chamber 52 as in the pressure chamber 40 and the injection valve element 28 is kept in its closed position, in which it rests with its sealing surface 34 against the valve seat 36 and closes the at least one injection opening 32 so that no fuel injection can occur. At a time determined by the control unit 62 as a function of operating parameters of the engine, the control unit 62 opens the second control valve 64 so that the control pressure chamber 52 is connected to the relief region and the pressure in the control pressure chamber 52 decreases. The relief of the control pressure chamber 52 reduces the force acting on the injection valve element 28 in the closing direction so that the pressure prevailing in the pressure chamber 40 moves this injection valve element 28 in the opening direction 29, thus opening the at least one injection opening 32 through which fuel is injected. It is possible that at first, only a small quantity of fuel is injected in a preinjection; then the control unit 62 closes the second control valve 64 again for a short time so that the pressure increases in the control pressure chamber 52 and the injection valve element 28 is moved into its closed position. It is also possible for there to be a number of preinjections in sequence.

For a main injection of a large quantity of fuel, the control unit 62 opens the second control valve 64 again for a time that corresponds to the fuel quantity to be injected. In order to terminate the main injection, the control unit 62 closes the second control valve 64 and opens the first control valve 60. This relieves the pump working chamber 22 through the opened connection 21 to the fuel supply pump 25 so that the high-pressure fuel pump 10 does not deliver any more fuel. The pressure drop in the pump working chamber 22 causes the check valve 53 in the connection 13 to close. The control unit 62 closes the second control valve 64.

When the high-pressure fuel pump 10 delivers fuel to the pressure chamber 40 via the connection 13, it also delivers fuel via the connection 66 to the coupling device 70 and into the pressure reservoir 68. At the beginning of the fuel delivery by the high-pressure fuel pump 10, the piston 74 of the coupling device 70 is disposed in its end position oriented away from the pressure reservoir 68, in which the piston 74 is depicted with dashed lines in FIG. 1. During fuel delivery by the high-pressure fuel pump 10, the piston 74 is slid into its end position oriented toward the pressure reservoir 68, in which the piston is depicted with solid lines in FIG. 1, and thus executes a delivery stroke in that the fuel displaced from the cylinder bore 72 by the piston 74 is fed into the pressure reservoir 68. In addition, fuel is also delivered into the pressure reservoir 68 via the conduit 76 in the piston 74, the flow through the conduit 76 being limited by the throttle restriction 77. After the end of the main injection, an elevated pressure is maintained in the pressure chamber 40, the control pressure chamber 52, and the connection 13 downstream of the check valve 53, which likewise results in a filling of the pressure reservoir 68 via the conduit 76 in the piston 74.

To execute one or more secondary injections, the control unit 62 opens the second control valve 64 so as to relieve the pressure in the control pressure chamber 52. Fuel then flows out of the pressure reservoir 68 at the pressure prevailing in the pressure reservoir 68 and into the pressure chamber 40, permitting the injection valve element 28 to open and thus permitting an injection of fuel. In addition, the piston 74 of the coupling device 70 also executes a delivery stroke oriented away from the pressure reservoir 68 and displaces fuel from the cylinder bore 72 into the pressure chamber 40. The pressure reservoir 68 and the coupling device 70 thus permit a fuel injection, in particular a secondary injection, independent of the fuel delivery by the high-pressure fuel pump 10. A secondary injection is advantageous in order to reduce emissions, especially particulate emissions, of the engine and permits a regeneration of exhaust treatment devices such as particulate filters or catalytic converters. An injection cycle includes at least one preinjection, a main injection, and at least one secondary injection.

At the beginning of the next injection cycle, the piston 74 of the coupling device 70 is then disposed, as explained above, in a position oriented away from the pressure reservoir 68 and during fuel delivery by the high-pressure fuel pump 10, moves into its end position oriented toward the pressure reservoir 68.

FIG. 2 shows a detail of the fuel injection system according to a second exemplary embodiment, in which the basic design is the same as in the first exemplary embodiment and only the coupling device 170 has been modified. The coupling device 170 has the cylinder bore 172 in which the piston 174 is guided in a sliding fashion. The bypass connection is constituted by a small diameter annular gap 176 between the cylinder bore 172 and the outer circumference of the piston 174, which annular gap also constitutes a throttle restriction. In the second exemplary embodiment, however, the bypass connection can also be embodied the same as in the first exemplary embodiment, in the form of a conduit that contains a throttle restriction and extends through the piston 174. Spring elements 178 and 180 that are embodied as helical compression springs engage the piston 174 at both ends. The spring 178 that engages the end surface of the piston 174 oriented toward the pressure reservoir 68 acts on the piston 174 in the direction oriented away from the pressure reservoir 68 and the spring 180 that engages the end surface of the piston 174 oriented away from the pressure reservoir 68 acts on the piston 174 in the direction oriented toward the pressure reservoir 68. Between two successive injection cycles, the two springs 178, 180 hold the piston 174 in a middle position depicted with solid lines in FIG. 2, between its two end positions. During fuel delivery into the pressure reservoir 68 as part of an injection cycle, the piston 174 is slid from its middle position into its end position oriented toward the pressure reservoir 68. The piston 174 remains in this end position until a withdrawal of fuel from the pressure reservoir 68 produces a secondary fuel injection in which the piston 174 is slid past its middle position into its end position oriented away from the pressure reservoir 68. After the end of the secondary injection and therefore after an injection cycle, the springs 178, 180 move the piston 174 back into its middle position. At the beginning of fuel delivery by the high-pressure fuel pump 10 during the next injection cycle, the piston 174 is therefore always disposed in its definite middle position, which is its starting position. The remaining functions of the fuel injection system according to the second exemplary embodiment are the same as in the first exemplary embodiment.

FIG. 3 shows the fuel injection system according to a third exemplary embodiment in which once again, only the coupling device 270 has been modified in relation to the first exemplary embodiment. The coupling device 270 has the cylinder bore 272 in which the piston 274 is guided in a sliding fashion. The piston 274 contains the bypass conduit 276 with the throttle restriction 277. Alternatively, the bypass conduit can also be embodied as in the second exemplary embodiment, in the form of an annular gap between the piston 274 and the cylinder 272. A spring element 280 in the form of a helical compression spring engages the end surface of the piston 274 oriented away from the pressure reservoir 68 and acts on the piston 274 in the direction of its end position oriented toward the pressure reservoir 68. Between two successive injection cycles, the spring 280 holds the piston 274 in its end position oriented toward the pressure reservoir 68, which position is depicted with solid lines in FIG. 3. During an injection cycle, fuel is delivered into the pressure reservoir 68 only via the conduit 276; the throttle restriction 277 must be large enough to permit a sufficient filling of the pressure reservoir 68. The piston 274 remains in this end position until a withdrawal of fuel from the pressure reservoir 68 results in a secondary injection of fuel during which the piston 274 is slid into its end position oriented away from the pressure reservoir 68. After the end of the secondary injection and therefore after an injection cycle, the spring 280 moves the piston 274 back into its end position oriented toward the pressure reservoir 68. At the beginning of fuel delivery by the high-pressure fuel pump 10 in the next injection cycle, the piston 274 is therefore always disposed in its definite end position oriented toward the pressure reservoir 68, which is its starting position. The remaining functions of the fuel injection system according to the third exemplary embodiment are the same as in the first exemplary embodiment.

The foregoing relates to preferred exemplary embodiments of the invention, it being understood that other variants and embodiments thereof are possible within the spirit and scope of the invention, the latter being defined by the appended claims.

The invention claimed is:

1. A fuel injection system for an internal combustion engine, comprising a respective high-pressure fuel pump (10) and a fuel injection valve (12) connected to it for each cylinder of the internal combustion engine, the high-pressure fuel pump (10) having a pump piston (18) driven into a stroke motion and delimiting a pump working chamber (22), which can be connected to a low-pressure region (25) via a connection (21) that is controlled by an electrically actuated control valve (60), the fuel injection valve (12) having an injection valve element (28) that controls at least one injection opening (32) and is acted on in an opening direction (29) by the pressure prevailing in a pressure chamber (40), which can be connected to the pump working chamber (22), an electrical control element (64) controlling an opening and closing motion of the injection valve element (28), a pressure reservoir (68) communicating with the pump working chamber (22) via a connection (66) through which fuel is delivered into the pressure reservoir (68) during the delivery stroke of the pump piston (18) and also communicating with the pressure chamber (40) of the fuel injection valve (12) via the connection (66) through which the pressure chamber (40) can be supplied with fuel from the pressure reservoir (68) for a fuel injection via the fuel injection valve (12) independent of the delivery stroke of the pump piston (18), the connection (66) of the pressure reservoir (68) to the pump working chamber (22) and pressure chamber (40) containing a coupling device (70; 170; 270), which contains a sliding piston (74; 174; 274) that is acted on at one end by the pressure prevailing in the pressure reservoir (68) and is acted on at the other end by the pressure prevailing in the connection (66), the piston (74; 174; 274) executing a delivery stroke oriented toward the pressure chamber (40) in order to execute a fuel injection, and the coupling device (70; 170; 270) containing a bypass connection (76, 77; 176; 276, 277) via which the connection (66) communicates with the pressure reservoir (68).

2. The fuel injection system according to claim 1, wherein the bypass connection comprises a conduit (76; 176; 276) that extends through the piston (74; 174; 274) and contains a throttle restriction (77; 177; 277).

3. The fuel injection system according to claim 1, wherein the bypass connection comprises of a conduit (176) that is formed between the outer circumference of the piston (174) and a cylinder bore (172) in which the cylinder (174) is guided.

4. The fuel injection system according to claim 1, wherein the piston (74; 174) executes a stroke oriented toward the pressure reservoir (68) in order to fill the pressure reservoir (68).

5. The fuel injection system according to claim 2, wherein the piston (74; 174) executes a stroke oriented toward the pressure reservoir (68) in order to fill the pressure reservoir (68).

6. The fuel injection system according to claim 3, wherein the piston (74; 174) executes a stroke oriented toward the pressure reservoir (68) in order to fill the pressure reservoir (68).

7. The fuel injection system according to claim 4, wherein the piston (74; 174; 274) can be moved between a definite end position oriented toward the pressure reservoir (68) and a definite end position oriented toward the connection (66).

8. The fuel injection system according to claim 5, wherein the piston (74; 174; 274) can be moved between a definite end position oriented toward the pressure reservoir (68) and a definite end position oriented toward the connection (66).

9. The fuel injection system according to claim 6, wherein the piston (74; 174; 274) can be moved between a definite end position oriented toward the pressure reservoir (68) and a definite end position oriented toward the connection (66).

10. The fuel injection system according to claim 4, further comprising at least one spring element (178, 180; 280) acting on the piston (174; 274) in the direction of at least one end position.

11. The fuel injection system according to claim 5, further comprising at least one spring element (178, 180; 280) acting on the piston (174; 274) in the direction of at least one end position.

12. The fuel injection system according to claim 6, further comprising at least one spring element (178, 180; 280) acting on the piston (174; 274) in the direction of at least one end position.

13. The fuel injection system according to claim 4, further comprising two spring elements (178, 180) one acting on the piston (174) in the direction toward opposite end positions, and wherein between two successive injection cycles, the spring elements (178, 20) hold the piston (174) in a definite intermediate position between the two end positions.

14. The fuel injection system according to claim 5, further comprising two spring elements (178, 180) one acting on the piston (174) in the direction toward opposite end positions, and wherein between two successive injection cycles, the spring elements (178, 20) hold the piston (174) in a definite intermediate position between the two end positions.

15. The fuel injection system according to claim 6, further comprising two spring elements (178, 180) one acting on the piston (174) in the direction toward opposite end positions, and wherein between two successive injection cycles, the spring elements (178, 20) hold the piston (174) in a definite intermediate position between the two end positions.

16. The fuel injection system according to claim 4, further comprising a spring element (280) holding the piston (274) in its end position oriented toward the pressure reservoir (68) between two successive injection cycles.

17. The fuel injection system according to claim 5, further comprising a spring element (280) holding the piston (274) in its end position oriented toward the pressure reservoir (68) between two successive injection cycles.

18. The fuel injection system according to claim 6, further comprising a spring element (280) holding the piston (274) in its end position oriented toward the pressure reservoir (68) between two successive injection cycles.

19. The fuel injection system according to claim 1, further comprising a pressure relief device (69) which limits the pressure in the pressure reservoir (68) to a predetermined value.

* * * * *